United States Patent [19]

Naevestad

[11] 4,087,333

[45] May 2, 1978

[54] TRAVELING HOOD FOR COKE OVEN EMISSION CONTROL

[75] Inventor: Roy Naevestad, Fanwood, N.J.

[73] Assignee: Wilputte Corporation, New Providence, N.J.

[21] Appl. No.: 690,415

[22] Filed: May 27, 1976

[51] Int. Cl.[2] ..... C10B 27/00; C10B 39/00

[52] U.S. Cl. ..... 202/227; 98/115 VM; 202/263; 202/269; 202/270; 214/18 R

[58] Field of Search ..... 202/227–230, 202/262, 263, 270, 269; 98/115 VM; 214/18 R; 104/94

[56] References Cited

U.S. PATENT DOCUMENTS

| | | | |
|---|---|---|---|
| 3,647,636 | 3/1972 | Helm | 202/263 |
| 3,715,282 | 2/1973 | Pries et al. | 202/263 |
| 3,801,473 | 4/1974 | Schoen et al. | 202/263 |
| 3,846,252 | 11/1974 | Edgar et al. | 202/263 X |
| 3,852,159 | 12/1974 | McClelland | 202/227 |
| 3,868,309 | 2/1975 | Sustaric et al. | 202/263 X |
| 3,913,470 | 10/1975 | Cullen | 202/263 X |
| 3,955,484 | 5/1976 | Hirahama et al. | 202/263 X |
| 3,981,778 | 9/1976 | Schulte et al. | 202/263 |

*Primary Examiner*—Morris O. Wolk
*Assistant Examiner*—Michael S. Marcus
*Attorney, Agent, or Firm*—Buell, Blenko & Ziesenheim

[57] ABSTRACT

A coke oven emission control system comprising a traveling hood for the quench car into which hot coke is pushed from the coke oven. The hood is independently supported by wheels traveling on rails and is of a length to cover the entire length of the quench car. The hood is moved by the movement of the quench car to and from a quench station, through beams at opposite ends of the quench car that are selectively raised and lowered into and out of a position for engagement with the hood. The top of the hood is provided with a central elongate hollow neck which projects upwardly into a longitudinally slotted exhaust duct paralleling the battery of ovens. The slot in the duct has a pair of parallel extending flexible sealing strips which are biased toward sealing engagement with each other across the slot and which separate to seal on the neck of the hood as it slides longitudinally along the duct. Selective communication is thus provided for flow of fumes, gas, smoke, particulates, etc. from the hood into the exhaust duct from the oven being pushed.

2 Claims, 5 Drawing Figures

TRAVELING HOOD FOR COKE OVEN EMISSION CONTROL

Figure 1:
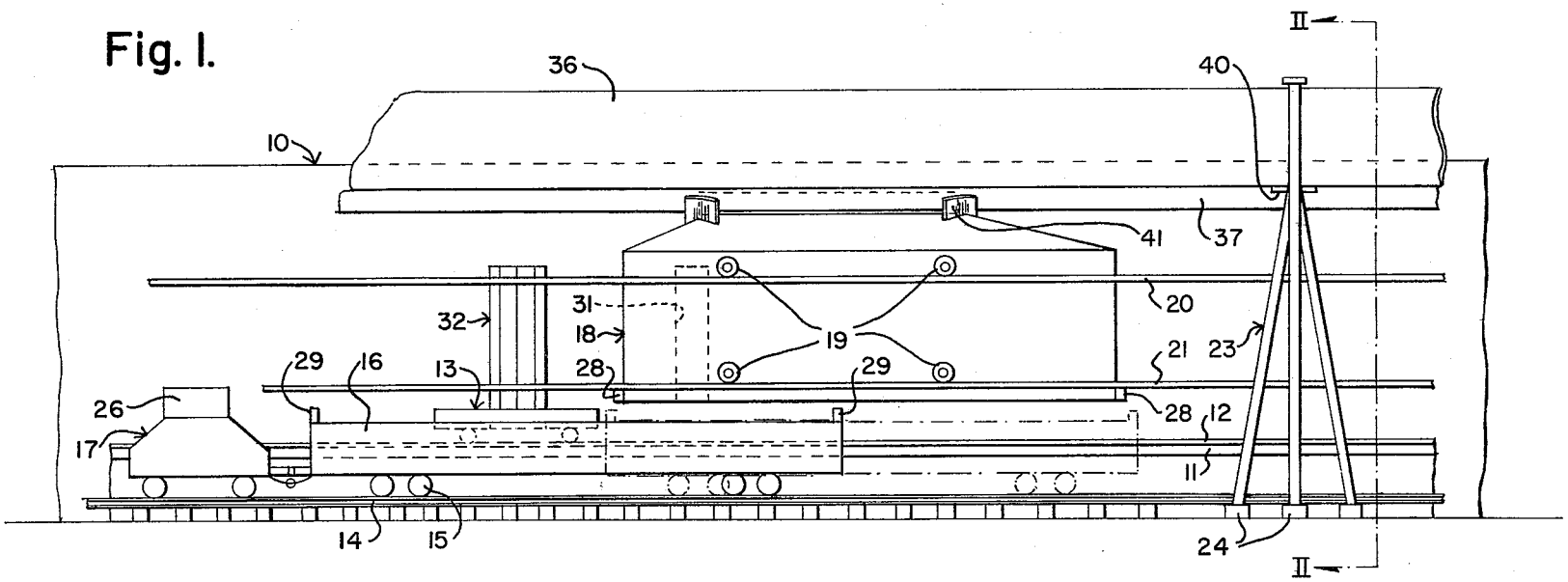

This invention relates to coke oven emission control systems for preventing air pollution by fumes, gas, and particulates discharged into the atmosphere above a quench car at the time the hot coke is pushed out of a coke oven at the conclusion of the heating cycle. Specifically, the invention relates to traveling hood means superposed over the quench car and alignable with different ovens of a coke oven battery, at the time a coke oven is pushed, to collect therein the fumes, gas and particulates arising from the pushing operation. In particular, the invention relates to a traveling hood having a sliding connection with an exhaust duct paralleling the coke oven battery via which the fumes, gas and particulates are transmitted to cleaning and scrubbing apparatus before release to the atmosphere. With the advent of anti-air-pollution legislation generally throughout industrial communities, particularly in areas having steel-making facilities requiring coke, proposals have been made for reducing or eliminating the air pollution due to smoke, toxic fumes and gases as well as particulates dispersed into the ambient atmosphere surrounding the coke oven batteries incidental to pushing of the hot coke out of the ovens into quench cars traveling on rails paralleling the ovens. These proposals include various forms of hoods movable into position to collect the smoke, fumes and particulates dispersed from the operation of pushing the hot coke into a quench car. In U.S. Pat. Nos. 3,801,472 and 3,801,473, both issued Apr. 2, 1974, the hood means is adapted to be connected through telescoping duct work or a water trough type of seal to an exhaust duct paralleling the coke oven battery via which the smoke fumes, and particulates are conveyed to scrubbers and cleaners before being released to the atmosphere U.S. Pat. No. 3,729,384, issued Apr. 24, 1973, discloses a traveling hood means having a connection to an exhaust duct via a longitudinal flexible belt, which closes one side of an exhaust duct except at the point of the oven being pushed.

It is the purpose of this invention to provide a traveling hood means for coke oven emission control, wherein the hood has an elongate neck which slidably projects into a longitudinal slot in an exhaust duct, the neck making sealing contact with a pair of parallel-extending sealing strips, attached to the edges of the longitudinal slot in the duct, and which sealingly close the slot in the duct except to the extent that the neck of the hood is interposed between the sealing strips.

It is a further purpose of the invention to provide a traveling hood for coke oven emission control which is adapted to be engaged at its opposite ends by arms carried at opposite ends of a quench car, which arms are selectively extendable from a retracted position to cooperatively abut one end of the hood and to thereby effect the movement of the hood longitudinally with respect to the coke oven battery into alignment with a coke oven to be pushed, by corresponding movement of the quench car. Moreover, the arms in their respective retracted positions permit movement of the quench car longitudinally under the hood to distribute the hot coke being pushed throughout the length of the quench car and to travel to a quenching station removed from the hood. Operation of the retractible arms on the quench car is effected by remote control of an operator on a locomotive which is coupled to the quench car for moving the quench car.

Figure 2:
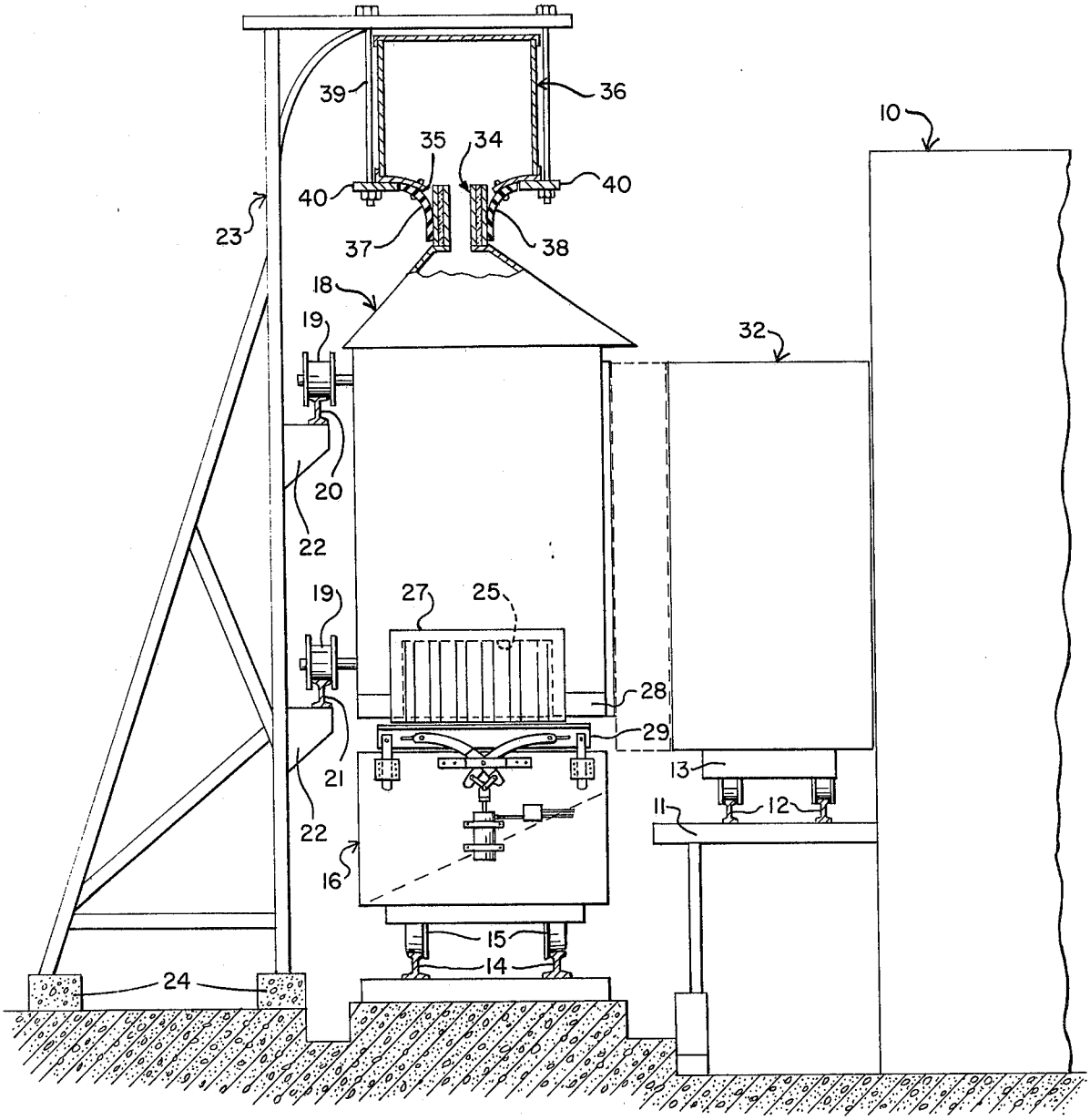
Figure 3:
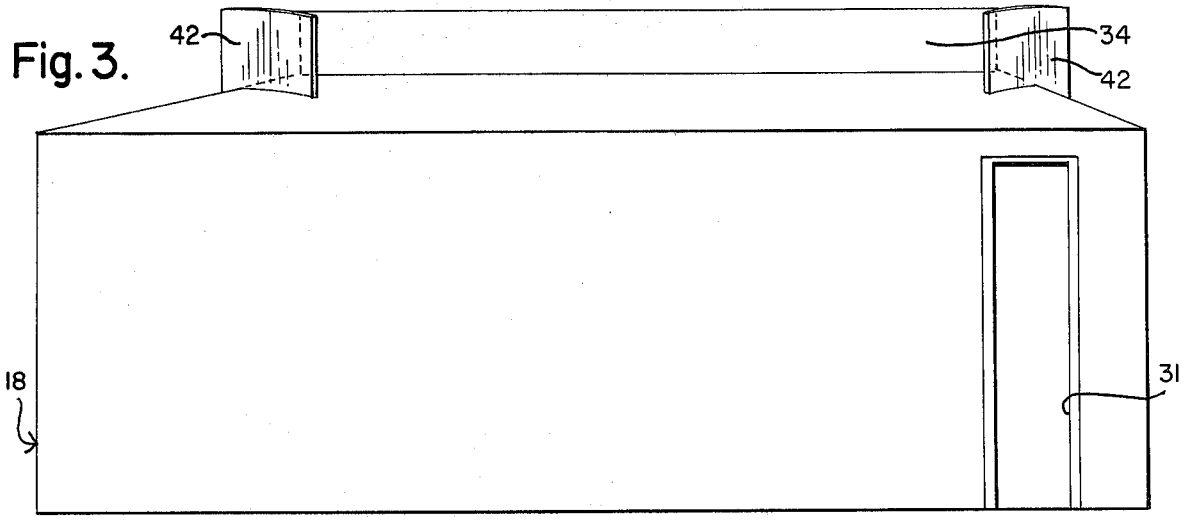
Figure 4:
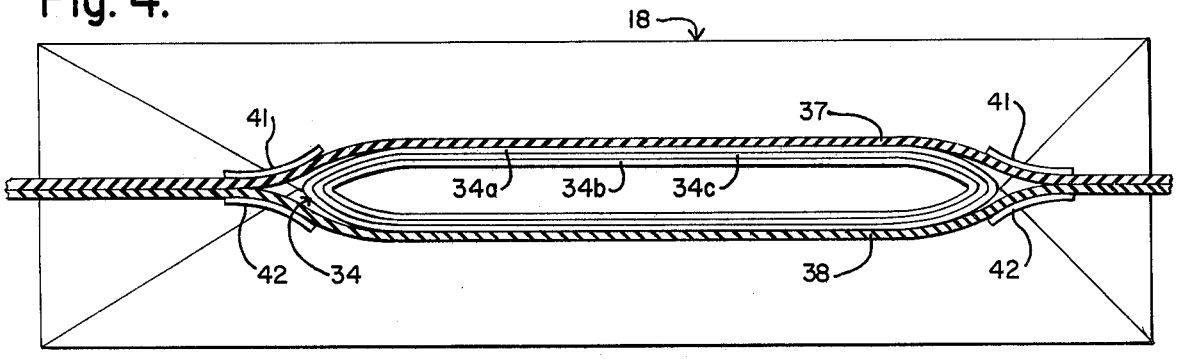
Figure 5:
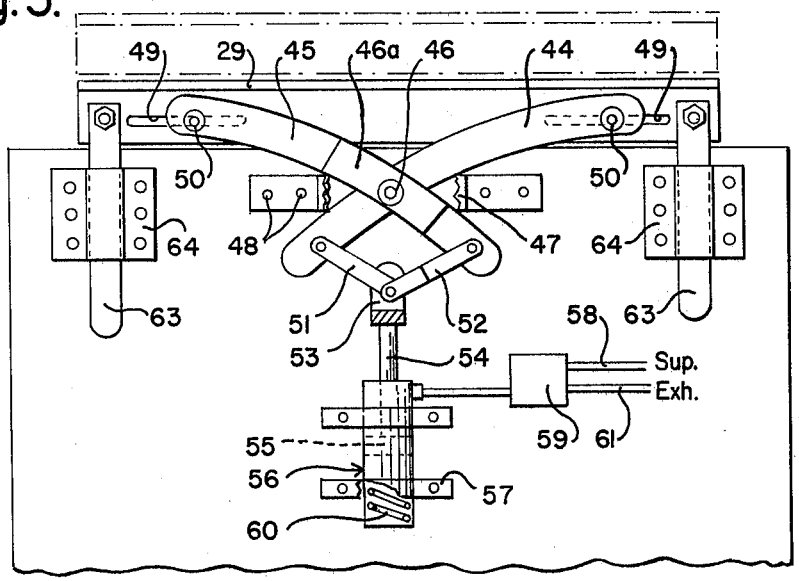

A preferred embodiment of the invention is described in greater detail hereinafter in connection with the accompanying drawings, wherein:

FIG. 1 is an elevational view showing a coke emission control system embodying my novel traveling hood, FIG. 2 is a transverse view, taken on the line II—II of FIG. 1, showing the manner of support of the traveling hood and its cooperative relation with a longitudinally extending exhaust duct for smoke, fumes and particulates, FIGS. 3 and 4 are elevational and plan views, respectively, of the traveling hood, showing details of the neck through which a sliding connection with the exhaust duct is provided, and FIG. 5 is a fragmental view of one end of a quench car, showing a movable hood-engaging mechanism thereon.

Referring to the drawings, there is shown a battery of coke ovens 10 having a longitudinally extending platform 11 in front of and paralleling the coke oven battery having rails 12 thereon on which a coke guide car 13 operates. Parallel to and farther removed from the coke oven battery than the platform 11 is a railroad track having rails 14 on which the wheels 15 of a quench car 16 run.

A low-profile locomotive 17, removably coupled to the quench car 16 through conventional car couplers (not shown), serves to push and pull the quench car 16 along the rails 14, as more particularly described hereafter.

A traveling hood 18 is supported for travel longitudinally with respect to the coke oven battery 10, by means of upper and lower sets of wheels 19 that engage upper and lower rails 20 and 21 respectively. Wheels 19 are shown as of the deeply grooved pulley type so that the cooperation of the flanges on the upper set of wheels with the rail 20 holds the hood in vertical position. Rails 20 and 21 are supported in a horizontal position on brackets 22 attached at corresponding levels to a series of suitable longitudinally spaced steel towers 23, only one of which is shown in FIGS. 1 and 2. The steel towers 23 are suitably anchored in concrete pedestals 24 in the ground at substantially the same level as the track rails 14.

The traveling hood 18 is provided with a suitable structural steel framework, covered by sheet metal. The hood is of elongated rectangular form, substantially equivalent in length and width to the area of the quench car 16 which is open at the top. The bottom of the hood is completely open and when suspended over the quench car closely approaches the top edge of the quench car. The gap between the hood and the sides of the quench car is preferably closed by a flexible curtain (not shown) such as of the chain type to permit the proper amount of leakage of ambient air into the hood to control the temperature of the gases in the hood which are removed as hereafter described.

As viewed in FIG. 2, each of the end walls of the hood is made with a recessed opening 25 to provide passage for the top turret-portion 26 of the locomotive 17 therethrough in passing under the hood, as more fully described hereafter.

In order to confine the smoke, fumes and particulates accumulated within the hood against escape out through the openings 25 at each end of the hood, a suitable flexible screen 27 is attached to the end wall over each opening in a manner to allow free passage of the locomotive turret-portion 26 under the hood. The screens 27 may be made of composition material, such as asbestos compounds or of metallic nature. If desired, the screens may be formed by a number of laterally overlapping vertical segments.

Also secured along the bottom edge of each end wall of the hood are reinforcing structural members 28 which are adapted to be engaged by an extendible beam member 29 on each end of the quench car and hereafter more fully described.

As seen in FIGS. 3 and 4, the side wall of the hood nearer to the coke oven battery is provided with a doorway 31 adjacent one end. The doorway is of a width corresponding to the space between the side walls of a coke guide 32 carried on the platform or floor of the coke guide car 13. As more clearly evident in FIGS. 1 and 2, coke guide 32 comprises a structural frame covered on top, bottom and sides with sheet metal and providing a tunnel through which the hot coke, pushed out of the coke oven aligned therewith, passes to reach the open-top quench car. It will be understood that the side walls and top of the coke guide 32 are provided with extensible or hinged sections, which are adapted to be extended to the flange of the doorway 31 in the manner shown by broken lines in FIG. 2. These extensible sections are adapted to seal against the jamb of the doorway 31 so as to prevent escape of smoke, fumes and particulates as the hot coke traverses the tunnel of the coke guide in passing to the quench car.

The roof or top of the hood 18 is structurally formed to support an elongated neck member 34 which extends upwardly into a longitudinal slot 35 in an exhaust duct 36, normally closed by two flexible sealing strips 37 and 38 secured along opposite edges of slot 35 and biased into sealing contact with each other. The slot 35 is shown as provided in the bottom surface of the duct for convenience of support for the duct 36. However, if the duct is appropriately supported, the slot 35 can be located in the sides or even the top of the duct. Suitable modification of the neck of the hood would however be necessary. Duct 36 is illustratively shown as of square cross section but any desired shape may be provided, such as a circular one. Duct 36 is supported at intervals along the length thereof, by cantilever arms at the top of the towers 23, in a position above and paralleling the track rails 14. Suitable means may be employed for attaching the duct 36 to the cantilever arms, such as rods 39 and plates 40.

The neck member 34 is of such length and the parallel sides thereof are so spaced apart that the area of the opening encompassed within the neck member is somewhat less than the cross-sectional area of the interior of the duct 36. An exhaust blower or fan (not shown) for conveying the smoke, gas, fumes and particulates through the duct away from the hood is necessarily provided. Such fan will necessarily be of a size to maintain a negative pressure within the duct at the juncture of the neck member with the duct to insure proper flow of fumes, gas, smoke and particulates away from the hood.

The neck member 34 of the hood is preferably of laminated construction, with outer and inner layers **34*a* and 34*b* respectively, of stainless steel, for example, and an intervening layer 34*c* of heat insulating material such as asbestos composition. The opposite ends of the neck member taper longitudinally to a small-radius nose or rounded end. Thus as the hood is shifted longitudinally parallel to the battery of coke ovens, the nose end of the collar separates the engaging edges of sealing strips 37 and 38 to move them apart to allow entry of the body of the neck member 34 following. Thus the neck member 34 remains constantly connected into the interior of the duct 36** as the hood moves longitudinally along the duct.

The tapered wearing surfaces of each of the end noses of the neck member 34 are preferably protected by two converging curved guide members 41 and 42 on the top of the hood symmetrically located on opposite sides of the line of contact of the sealing strips 37, 38. The curvature of the guide members 41 and 42 is such as to provide an open V facing the nose end of the neck member. Conversely, the converging ends of the guide members 41 and 42 at the trailing nose end of the neck member, serve to move the sealing strips 37 and 38 back toward closed sealing contact as the neck member 34 moves out from between the sealing strips. The wear surface of guide members 41 and 42 may be provided with rollers (not shown) to ease friction with the sealing strips and minimize wear thereon.

The flexible sealing strips 37 and 38 are preferably made of high-temperature rubber or other elastomer. The strips 37 and 38 may have suitable metallic reinforcing strips with spring action for insuring a biasing action of the two strips into closed sealing contact with each other preceding and following the neck member 34. Alternatively, the two strips may be flexible metallic strips having curved contours biased into closed contact with each other, and with elastomeric sealing lips along the line of contact of the strips.

Referring to FIG. 5, the mechanism for raising and lowering the beam member 29 at each of the quench car may be of any suitable construction. As shown, it comprises a pantograph mechanism in the form of two relatively long curved lever members 44 and 45 in crossed position and fulcrumed on a pin or bolt 46. One of the members, shown as member 45, is formed with an offset portion **46*a* at the fulcrum pin to enable the lever members to move in the same plane. A strap member 47, with an offset portion midway of the ends, is secured as by rivets 48 to the end wall of the quench car and serves as an outer bearing support for the pin 46**.

The beam member 29 is illustratively shown in the form of an angle bar having horizontally extending slots 49 adjacent opposite ends thereof, with the upper ends of the lever members 44 and 45 being coupled to the beam member 29 by bolts or rivets 50 extending through the slots 49.

The shorter arms of the lever members below the fulcrum pin 46 are connected by respective links 51 and 52 to a clevis 53 at the distal end of a piston rod 54. The rod 54 is connected to a piston 55 in a cylinder 56 attached as by straps 57 riveted to the end wall of the quench car.

The piston 55 of cylinder 56 is single acting, being activated by fluid pressure, such as air supplied to one side thereof, via supply pipe 58 under control of a valve 59, from a suitable source such as the auxiliary reservoir (not shown) of the conventional air brake system on the car. Piston 55 moves downwardly in cylinder 56 responsively to the fluid pressure, in opposition to a coil spring 60 and the lever members 44 and 45 are fulcrumed upwardly correspondingly, to raise beam 29 to the raised position indicated by broken lines. Upon release of fluid pressure from cylinder 56 by operation of valve 59, fluid pressure escapes to atmosphere via an exhaust pipe 61, and spring 60 thereupon biases the piston 55 and piston rod 54 upwardly to restore lever members 44 and 45 and beam member 29 to their lowered positions.

Preferably the opposite ends of the beam 29 have guide bars 63 attached thereto which move vertically in guide slots formed by brackets 64 attached as by rivets to the end wall of the quench car. As will be explained later on, the guide bars 63 serve to support the beam 29 against horizontal thrust forces thereon when the beam 29 is in raised position for engaging the strike plate 28 on the hood to move the hood with the quench car.

The valve 59 is remotely controlled from the turret-like cab of the locomotive 17 by the operator of the locomotive, as through conventional electrical signal wires or through conventional fluid pressure control signal pipes.

The controls for the valves 59 at opposite ends of the quench car are so interlocked that it is possible for the locomotive operator to raise only one beam 29 at a time so as to engage the hood, for reasons which will become apparent later on.

Suitable automatic trip mechanism alongside the quench car track will necessarily be provided to so control the valves 59 on the quench car to insure the raised pushing beam 29 on the quench car being restored to its lower position at the proper time so as to disengage the hood 18. As will become clear later on, this is necessary in order to prevent damage to the hood, occasioned by being pushed past the end of the rails 20, 21 on which it travels.

In operation, let it be assumed that the hood 18 is positioned on rails 20, 21 so that the doorway 31 in the hood is in registry with a particular coke oven that is to be pushed. Assume further that the conventional door opening and closing machine that operates on the coke guide car rails 12, has been moved out of the way after opening the door for an oven of battery 10 that is to be pushed. The coke guide car is now shifted into position between the open oven door and the doorway 31 of the hood 18 and the side and top extensions of the coke guide are shifted to provide a sealed tunnel between the oven door and the hood 18. As the coke in the oven is pushed, by conventional ram equipment, out of the oven door through the coke guide into the quench car, the operator of the locomotive 17 causes the locomotive to push the quench car 16 progressively further under the hood from the initial position shown in FIG. 1 to the position shown by the broken lines. Thus, as the hot coke being pushed out of the oven continues to drop into the quench car, it is distributed along the length of the quench car. At the conclusion of the "push", the quench car 16 is completely under the hood 18. During this interval, the smoke, gas fumes and particulates emitted by the hot coke being dumped into the quench car is collected and rises in the hood 18. Due to the suction in the duct 36, the smoke, gas fumes and particulates are drawn into the duct through the neck member 34 and thence conveyed to the remotely located strainer and cleaner before being released to the atmosphere.

At the conclusion of the "push" the operator of the locomotive causes the beam 29 at the end of the quench car nearest to the locomotive to be raised by the cylinder 56 to its upper position, indicated by the broken lines in FIG. 5. With the beam 29 in its upper position, the operator of the locomotive now causes the beam to move into engagement with the strike plate 28 on the hood, after which further movement of the locomotive along the track rails 14 moves the quench car and hood simultaneously toward the quenching station.

Just outside the quench station, the automatic trip mechanism causes the raised beam 29 to be lowered to its normal position in which the locomotive is free to continue to move under the hood and to move the quench car freely into the totally enclosed quench station (not shown) where the hot coke in the quench car is quenched by water from spray. At the conclusion of the quenching operation, the operator of the locomotive causes the quench car to return back to a position under the hood, at which time the operator causes the beam 29 at the right-hand end of the quench car (as viewed in FIG. 1) to be raised to its upper position. With the said beam 29 raised, further travel of the locomotive away from the quenching station, engages beam 29 with the plate 28 at the corresponding end of the hood and, thereafter, both hood and quench car are moved together back to a position opposite the next oven to be pushed. At this point, the operator of the locomotive causes the beam 29 to be returned to its lower position, thereby enabling the quench car to continue to move under the hood and to the dumping zone for the quenched coke, where the quench car is dumped. If desired, the operator may retain the beam 29 in raised position, in which case the hood remains over the quench car until the car is dumped. After the quench car is thus emptied, the operator of the locomotive causes the quench car, or the quench car and hood together, to be moved to the initial position shown in FIG. 1, for receipt of hot coke from the next oven to be pushed. The cycle of pushing, quenching an dumping of hot coke is then repeated for each of the ovens of the battery 10.

It will be seen that the traveling hood system which I have devised, is effective to contain emissions of smoke, gas, fumes etc. during the pushing cycle, during travel of the quench car to the quenching station, and during travel to the dumping wharf. The traveling hood and duct system lends itself to ready installation in existing plant facilities with little or no modification of existing facilities. The traveling hood arrangement is serviceable and requires little maintenance. Additional operating personnel are not required.

While the traveling hood system has been described herein in connection with coke oven emission control, it will be seen that the apparatus is suited for use in other situations, such as with coal charging car and pusher machines, for reducing pollution of the air surrounding a facility.

What I claim and desire to protect by Letters Patent is:

1. In a system for pushing coke from a battery of coke ovens comprising track rails paralleling the battery of coke ovens, a quench car traveling on said track rails, a locomotive also traveling on said track rails and adapted when coupled to said quench car to move it in opposite directions on said track, a second set of track rails paralleling and intervening between the ovens and the first said track rails, a coke guide car traveling on said second set of track rails, which coke guide car comprises a coke guide through which hot coke is pushed from an oven into the quench car, a hood of substantially the same length as the quench car, means supporting said hood in superposed relation over the quench car for movement into vertical alignment therewith so as to collect smoke, gas, fumes and particulates arising from hot coke deposited in the quench car, and an exhaust duct coextensive in length with said battery of coke ovens by which duct smoke, gas, fumes and particulates collected in said hood are carried away from said hood, the improvement comprising a member at each of the opposite ends of said quench car movable from a lower position, in which the quench car may pass under the hood, to a raised position in which the member contacts the end of the hood to exert a pushing force thereon to move the hood concurrently with the quench car, separate fluid power means for each of said members to effect raising and lowering thereof, and means for selectively controlling the said fluid power means.

2. In a system for pushing coke from a battery of coke ovens comprising track rails paralleling the battery of coke ovens, a quench car traveling on said track rails, a locomotive also traveling on said track rails and adapted when coupled to said quench car to move it in opposite directions on said track, a second set of track rails paralleling and intervening between the ovens and the first said track rails, a coke guide car traveling on said second set of track rails, which coke guide car comprises a coke guide through which hot coke is pushed from an oven into the quench car, a hood of substantially the same length as the quench car, means supporting said hood in superposed relation over the quench car for movement into vertical alignment therewith so as to collect smoke, gas, fumes and particulates arising from hot coke deposited in the quench car, and an exhaust duct coextensive in length with said battery of coke ovens by which duct smoke, gas, fumes and particulates collected in said hood are carried away from said hood, the improvement comprising a member at each of the opposite ends of said quench car movable from a lower position, in which the quench car may pass under the hood, to a raised position in which the member contacts the end of the hood to exert a pushing force thereon to move the hood concurrently with the quench car, fluid pressure actuated power means for raising and lowering each of said members, and remotely controlled valve means for controlling the supply and release of fluid pressure to and from said power means.

* * * * *